US007779559B2

(12) United States Patent
Fenato

(10) Patent No.: US 7,779,559 B2
(45) Date of Patent: Aug. 24, 2010

(54) SKI BOOT FOR ALPINE SKIING

(75) Inventor: Piero Fenato, Caerano di San Marco (IT)

(73) Assignee: Oberalp S.p.A., Bozano (IT)

( * ) Notice: Subject to any disclaimer, the term of this patent is extended or adjusted under 35 U.S.C. 154(b) by 745 days.

(21) Appl. No.: 11/712,905

(22) Filed: Mar. 2, 2007

(65) Prior Publication Data

US 2007/0204486 A1 Sep. 6, 2007

(30) Foreign Application Priority Data

Mar. 3, 2006 (IT) ..... VE20060010 U

(51) Int. Cl.
*A43B 5/04* (2006.01)

(52) U.S. Cl. ..... 36/117.1; 36/115

(58) Field of Classification Search ..... 36/117.1, 36/117.2, 117.3, 117.4, 115, 105, 82
See application file for complete search history.

(56) References Cited

U.S. PATENT DOCUMENTS 3,613,270 A * 10/1971 Eie ..... 36/117.3
3,618,233 A * 11/1971 Eie ..... 36/117.3
4,154,008 A * 5/1979 Jacobs ..... 36/117.2
4,351,120 A * 9/1982 Dalebout ..... 36/117.3
4,937,955 A * 7/1990 Bonaventure ..... 36/132
6,065,228 A * 5/2000 Begey et al. ..... 36/15
6,446,363 B1 * 9/2002 Artus ..... 36/117.3
6,609,313 B2 * 8/2003 Orso ..... 36/117.3
2002/0088146 A1 * 7/2002 Joseph et al. ..... 36/117.3
2002/0093175 A1 * 7/2002 Martin et al. ..... 280/613

* cited by examiner

*Primary Examiner*—Jila M Mohandesi
(74) *Attorney, Agent, or Firm*—Hoffman, Wasson & Gitler

(57) ABSTRACT

A boot for Alpine skiing has a shell and sole. The heel has a cavity, including a seat for the insertion of a removable metal insert for engagement by the heel fixing unit of a standardized "Dynafit" binding. However, when the boot is prepared for use with newer, different bindings, the metal insert is replaced by a plastic insert that fits over the cavity and forms a continuous, unbroken rim on the heel of the ski boot.

2 Claims, 1 Drawing Sheet

SKI BOOT FOR ALPINE SKIING

BACKGROUND OF THE INVENTION

The present invention relates to an improved ski boot for Alpine skiing.

Boots for alpine skiing are known in the art. They generally have a rigid shell of plastic material, provided with lever fastening devices and internally housing an inshoe of soft material. The front jaw and the heel fixing unit of the sole and shell are constructed in accordance with international regulations to adapt to different manufacturers' bindings.

In a known type of standard sole using the "Dynafit" binding system, the heel fixing unit comprises a cavity, part of which is occupied by a metal insert engagable with the binding. The metal insert does not fill the cavity, leaving a discontinuity in the rim of the heel. As new regulations are currently being launched in which the circumferential rim of the heel fixing unit must be substantially smooth, the problem of using the old alpine ski boots in association with the new regulations, while still enabling them to be used under the old regulations, has arisen.

SUMMARY OF THE INVENTION

A conventional boot for alpine skiing has a shell and sole. The heel has a cavity with a seat for the insertion of a removable metal insert for engagement by the heel fixing unit of a standardized "Dynafit" binding.

The object of the invention is to provide an improved boot for alpine skiing which can be used both with the bindings of the "Dynafit" system and with the bindings of the new regulations.

This object is attained according to the invention by an improved boot for alpine skiing comprising a shell, the sole of which is provided at the heel with a cavity including a seat for the insertion of a (1) removable insert for engagement by the heel fixing unit of a standardized "Dynafit" binding, or, alternatively (2) a plastic insert having the shape and dimensions corresponding to those of the cavity and seat.

While such arrangement functions satisfactorily, with standardized "Dynafit" bindings, the introduction of new regulations for different bindings has caused a problem. The new bindings are effective with a ski boot with a heel with a continuous, or unbroken, rim. The metal insert used in conjunction with "Dynafit" bindings results in a break, or discontinuity, in the rim of the heel of the ski boot. In order to allow existing ski boots to be used with known "Dynafit" bindings, as well as new bindings, which require a continuous unbroken rim on the heel of the boot, applicant has developed a plastic insert that fills the discontinuity and restores the continuity of the rim of the heel. Accordingly, known ski boots may be used, safely and satisfactorily with known "Dynafit" bindings and with newer bindings currently reaching the marketplace.

DETAILED DESCRIPTION OF THE INVENTION

Figure 6:
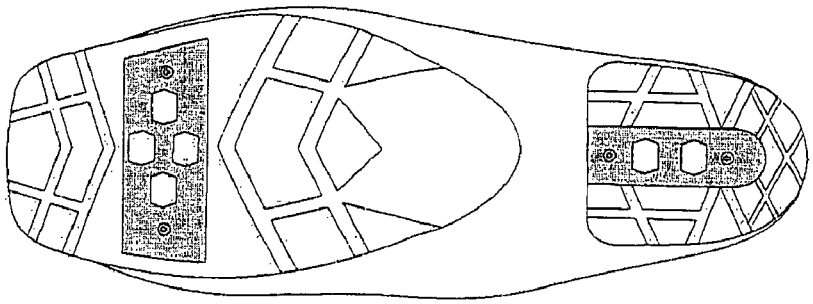
FIG. 6 shows the sole provided with anti-friction strips.
Figure 5:
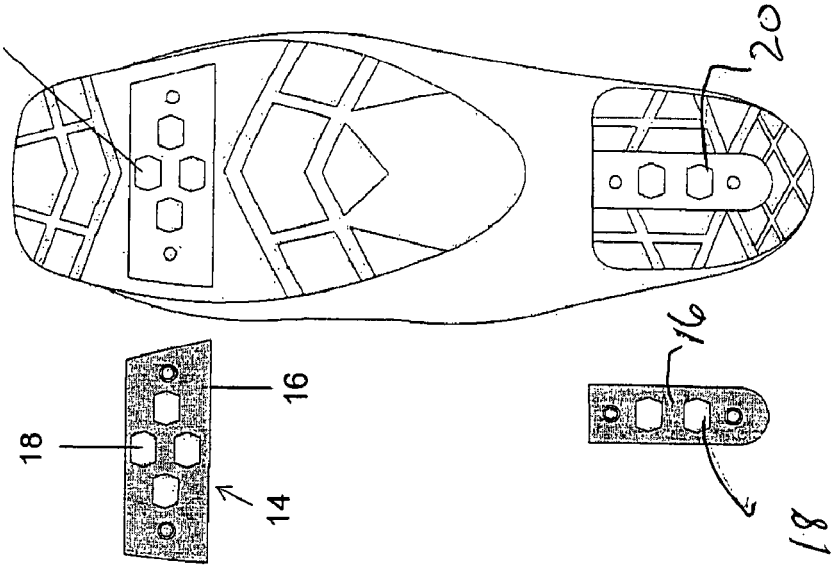
FIG. 5 is a plan view of the sole of a ski boot.
Figure 2:
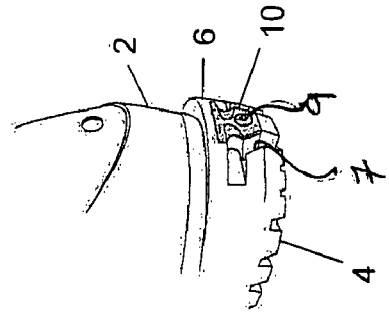
FIG. 2 shows it in assembled perspective view.

As can be seen from the figures, the alpine ski boot according to the invention comprises substantially a shell 2 of rigid plastic material housing internally a soft material inshoe (not shown in the drawings). The sole 4 includes a cavity 7 with a seat at the heel 6. A metal insert 10, suitable for use by the heel fixing unit of a binding, such as a standardized "Dynafit" ski binding is applied to the heel by screws 9. The metal insert does not completely fill cavity 7, as shown in FIG. 2.

Figure 4:
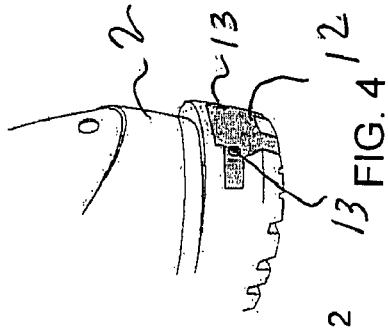
FIG. 4 shows it in assembled form.
Figure 1:
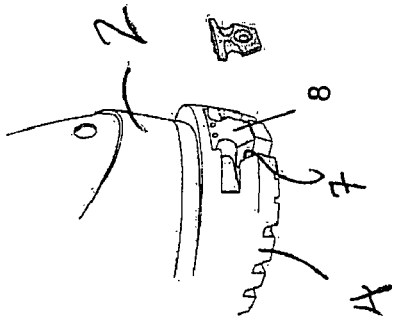
FIG. 1 is an exploded perspective view of the rear part of a ski boot in accordance with the "Dynafit" binding system.
Figure 3:
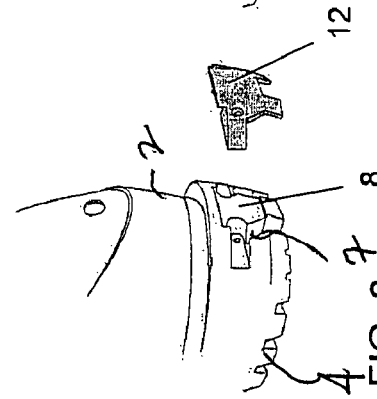
FIG. 3 is an exploded perspective view of the improved boot according to the new regulations.

An insert 12 of plastic material, the shape and dimensions of which correspond exactly to those of cavity 7 and is shown in FIGS. 3 and 4. When the insert 10 has been removed, the insert 12 can be applied to cavity 7 and seat 8 in order to change the sole heel to a substantially smooth conformation to adapt it to the new regulations. Insert 12 is retained in position by screws 13. In the smooth conformation, insert 12 does not extend beyond the contour of the heel, as seen in FIG. 4.

Moreover, as the regulations require the lower surface of the boot to present two antifriction strips in contact with the plates of the binding, these strips are obtained according to the invention by applying two caps presenting a substantially flat head 16 and several appendices 18, two or four, insertable into corresponding seats 20 provided in the boot sole.

In this manner, application of the caps creates two mutually perpendicular strips forming with their flat surface an anti-adhesion region against the plate of the binding.

From the aforegoing it is apparent that the improved boot of the invention presents the advantage of being able to be used both with bindings of the old regulations (Dynafit) and with bindings of the new regulations.

What is claimed is:

1. An improved boot for Alpine skiing comprising:

a) a shell having a sole and a heel;

b) a cavity located within a rim of said heel and opening outwardly to the rear of the boot;

c) a seat formed within said cavity;

d) a removable metal insert secured to said seat and partially filling said cavity to leave a discontinuity in said rim of the heel to engage with a first type of binding;

e) a replacement insert that can be substituted for said metal insert; and f) said replacement insert being secured to said seat to fill said cavity so that the rim of the heel of the boot is restored to a continuous, unbroken condition, whereby the heel is engaged with a different type of binding.

2. The improved boot for Alpine skiing as recited in claim 1, wherein said replacement insert is formed of plastic.

* * * * *